US007399232B1

(12) United States Patent
Frappier et al.

(10) Patent No.: US 7,399,232 B1
(45) Date of Patent: Jul. 15, 2008

(54) GOLF CLUB SWING TRAINING DEVICE AND METHOD

(76) Inventors: John P. Frappier, 1005 118th Ave. South, Horace, ND (US) 58047; Mark W. Johnson, 3511 Westmoor Blvd., Moorhead, MN (US) 56560

( * ) Notice: Subject to any disclaimer, the term of this patent is extended or adjusted under 35 U.S.C. 154(b) by 202 days.

(21) Appl. No.: 11/207,107

(22) Filed: Aug. 18, 2005

(51) Int. Cl.
*A63B 69/36* (2006.01)

(52) U.S. Cl. ..... 473/215; 473/207; 473/226; 473/227; 473/229

(58) Field of Classification Search ..... 473/207, 473/208, 212–216, 226, 227, 229, 277
See application file for complete search history.

(56) References Cited

U.S. PATENT DOCUMENTS

| | | | | |
|---|---|---|---|---|
| 2,103,502 | A * | 12/1937 | Webster | 473/215 |
| 3,595,583 | A * | 7/1971 | Oppenheimer | 473/215 |
| 4,134,589 | A * | 1/1979 | Arena | 473/208 |
| 7,128,658 | B2 * | 10/2006 | DuFour | 473/276 |
| 7,156,748 | B2 * | 1/2007 | Burke | 473/276 |

* cited by examiner

*Primary Examiner*—Raleigh W. Chiu
(74) *Attorney, Agent, or Firm*—Faegre & Benson LLP

(57) ABSTRACT

A device for training the muscles used during a golf club swinging motion. The device includes a connector coupled to the head of the golf club and a resilient and extensible tether having a proximal end for connection to the connector and a distal end for connection to a trainee's body. The device is used by causing the trainee to engage in a golf swing motion so that the tether provides resistance to the trainee's muscles in the sequence used to perform the swing.

16 Claims, 5 Drawing Sheets

GOLF CLUB SWING TRAINING DEVICE AND METHOD

TECHNICAL FIELD

This invention relates to devices used for athletic training. This invention relates more particularly to a device for strengthening and training the muscles used while swinging a golf club.

BACKGROUND

Extensive practice is required to develop a consistent and proper golf swing. Typical challenges encountered by golfers when improving their golf swing include slicing (hitting the ball so that it curves to the right for a right-handed golfer) and hooking (hitting the ball so that it curves to the left for a right-handed golfer). A variety of devices for improving a golf swing exist. A number of these devices include the use of mechanisms for checking the golfer's body alignment. One such device is disclosed in U.S. Pat. No. 6,805,641 to Pope. This device includes a support section, including an adjustable arm, and an engagement arm for contacting a dorsal surface of a golfer. Such devices are cumbersome to transport and use. They also do not train the muscles used during a golf swing in the sequence they are used.

The use of resilient and extensible tethers for training the muscles used during certain athletic movements is known. For example, a device for training the upper body is described in U.S. Pat. No. 5,518,480 to Frappier, herein incorporated by reference. This device is used to provide resistance to the arms, trunk and shoulders to improve performance in sports such as hockey, basketball, volleyball and baseball/softball. A device for training the lower body is described in U.S. Pat. No. 5,167,601 to Frappier, which is incorporated herein by reference. This device provides resistance to the lower extremities during sprinting and related motions. It is also known to train the muscles used during hockey stick swinging motions by attaching a resilient and extensible tether to a hockey stick and anchoring the tether to a wall.

Therefore, there is a need for an improved golf swing training device for training the muscles used during a golf swing in the sequence they are used. A device of this type that is relatively simple, easy to use, and portable would be especially desirable.

SUMMARY

The present invention is a device for training the muscles used during a golf club swinging motion and a method of using the device. The device comprises a connector coupled to the head of the golf club and a resilient and extensible tether having a proximal end for connection to the connector and a distal end for connection to a trainee's body. The method comprises securing a resilient and extensible tether between a trainee's body and a golf club head and causing the trainee to engage in a golf swing motion so that the tether provides resistance to the trainee's muscles in the sequence used to perform the desired motion.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

Figure 1:
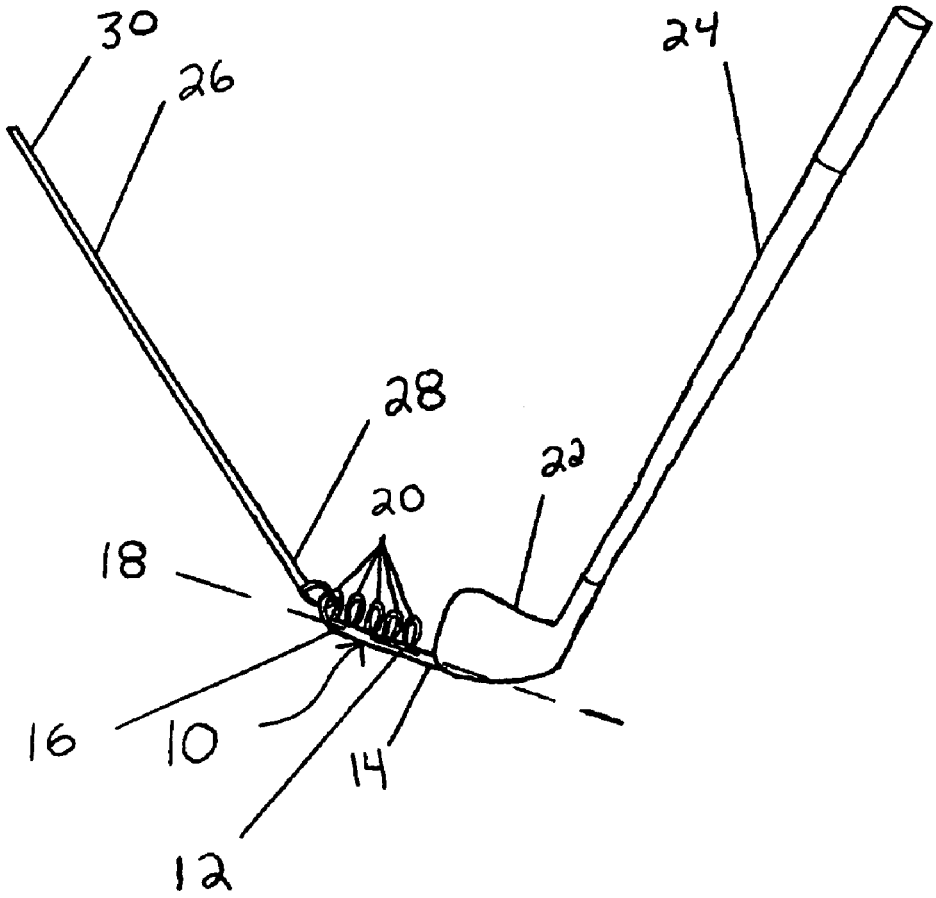
FIG. 1 is an illustration of a golf club swing training device in accordance with the present invention coupled to a golf club.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIG. 1 is a perspective view of one embodiment of the golf club swing training device 10 of the present invention. The golf club swing training device 10 is shown coupled to a golf club 24. The training device 10 includes a mounting member 12 having a proximal end 14, a distal end 16, and a longitudinal axis 18 extending from the proximal end 14 to the distal end 16. A plurality of connectors 20 are coupled to the mounting member 12 at spaced locations along the longitudinal axis 18. The proximal end 14 of the device 10 is coupled to a head 22 of the golf club 24. A resilient and extensible tether 26 has a proximal end 28 and a distal end 30, and is coupled to one of the connectors 20 at the tether proximal end 28. Although a plurality of connectors 20 are shown in FIG. 1, the mounting member 12 could alternatively have one connector 20, or any other number of connectors 20.

As shown in FIG. 1, the mounting member 12 extends from the golf club head 22 in a plane that is generally coplanar with the head 22. However, the orientation of the member 12 with respect to the club head 22 could take other forms. For example, the member 12 could extend at an angle oriented to the left, right, upward, or downward from the club head 22. The member 12 could also extend rearward of the club head 22, or extend in any other suitable manner.

Figure 2:
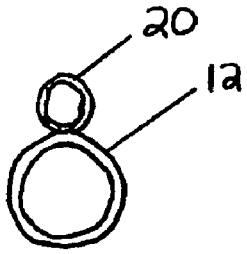
FIG. 2 is an end view of the training device shown in FIG. 1.

FIG. 2 shows an end view of the mounting member 12 shown in FIG. 1. In the embodiment shown in FIGS. 1-2, the mounting member 12 is elongated and has a substantially circular or annular cross-section. Alternatively, the mounting member 12 could have a substantially square, substantially rectangular, or other cross-section. The member 12 could be hollow or solid. The member 12 could be comprised of steel, plastic, or any other suitable material. In the embodiment shown in FIGS. 1-2, the connectors 20 have an annular shape and are comprised of steel. The connectors 20 are welded to the member 12. Alternatively, the connectors 20 could be comprised of plastic or any other suitable material. The connectors 20 could take any other shape suitable for coupling to the tether 26. The connectors 20 can be permanently attached to the member 12, formed into the member 12, or releasably attached to the member 12 (for example, using a snap-fit connection).

The member 12 can be permanently attached to the golf club head 22 or releasably attached to the golf club head 22. The member 12 can be releasably attached using bolts, screws, or other fasteners. Alternatively, the member 12 could take the form of a sleeve for fitting over a portion of the golf club head 22. In one embodiment, a connector 20 could be directly coupled to the golf club head 22 instead of coupled to the member 20. The connector 20 could be permanently coupled to the golf club head 22 or releasably coupled to the golf club head. The training device 10 could also be used in connection with any device that simulates the action of a golf club, rather than an actual golf club such as the golf club 24. The training device 10 could be used in conjunction with a wood, an iron, or any other suitable golf club.

The tether 26, shown in FIG. 1, can be made of any elongated elastomeric and stretchable material long enough to allow for a sufficient range of motion while providing desired amounts of resistance to the arm muscles during the swinging motion. The location of the tether proximal end 28 along the longitudinal axis 18 controls the resistance applied to the trainee's muscles. For example, attachment of the tether proximal end 28 to the most distal connector 20 (as shown in FIG. 1) provides more resistance to the muscles used during a golf swing than attachment of the tether proximal end 28 to the most proximal connector 20.

Figure 3:
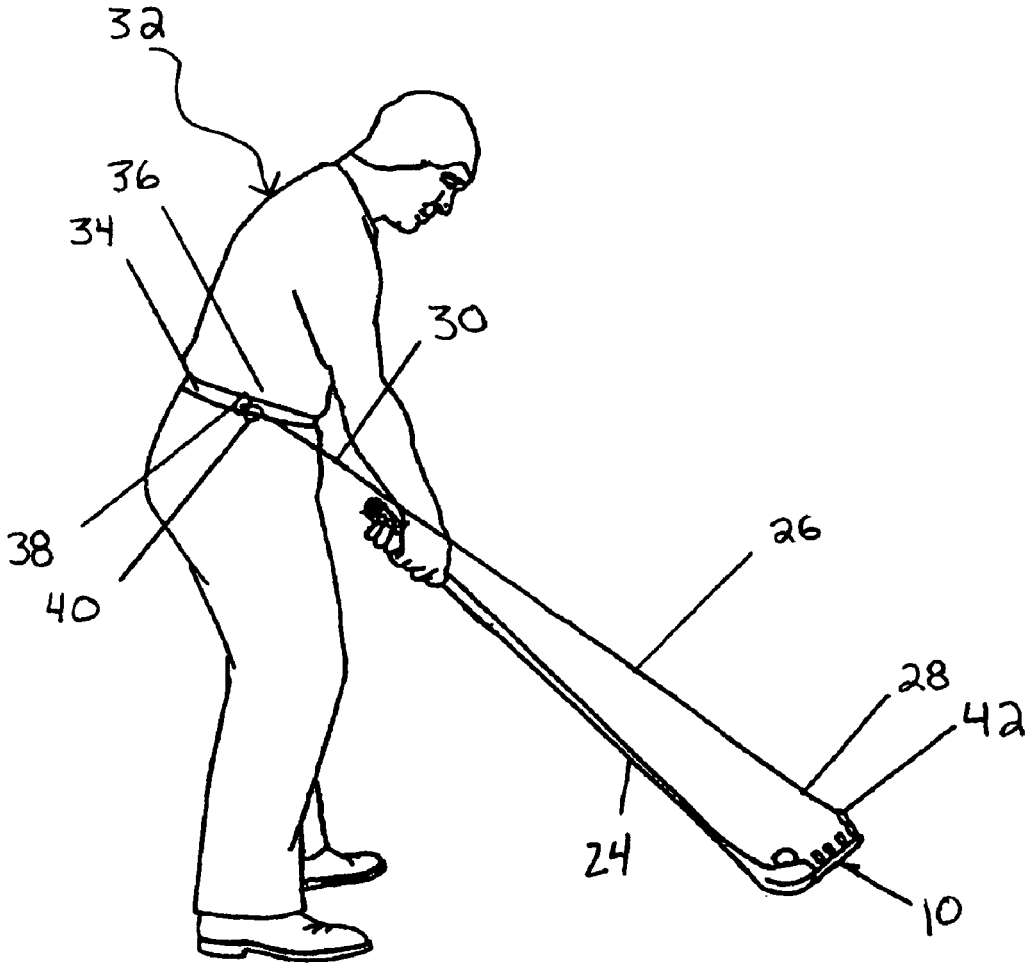
FIG. 3 is a side view of a trainee using the training device shown in FIGS. 1-2.

FIG. 3 is a side view of a trainee 32 using the golf training device 10. In this embodiment, a waistband 34 is worn around the midsection 36 of the trainee 32. The waistband 34 includes a connector 38 located to one side of the waistband 34. The waistband 34 can be secured by any suitable structure and is adjustable. In one embodiment, the waistband 34 is an elongate member that wraps around the trainee's waist and is releasably secured in the wrapped position by a hook and loop fastener. Alternatively, the waistband 34 could be secured using buckles, ties, or other structure. A connector 40 located at the tether distal end 30 is coupled to the connector 38. A connector 42 connects the tether proximal end 28 to the connector 20 on the member 12. In an alternative embodiment, the connector 40 could be coupled to a standard belt loop (not shown) or any other body attachment structure. The connector 38 and the connectors 40, 42 can be made of plastic, metal, or any other suitable material. In one embodiment, the connector 38 can comprise a D-ring and the connectors 40, 42 can comprise clips.

Figure 4C:
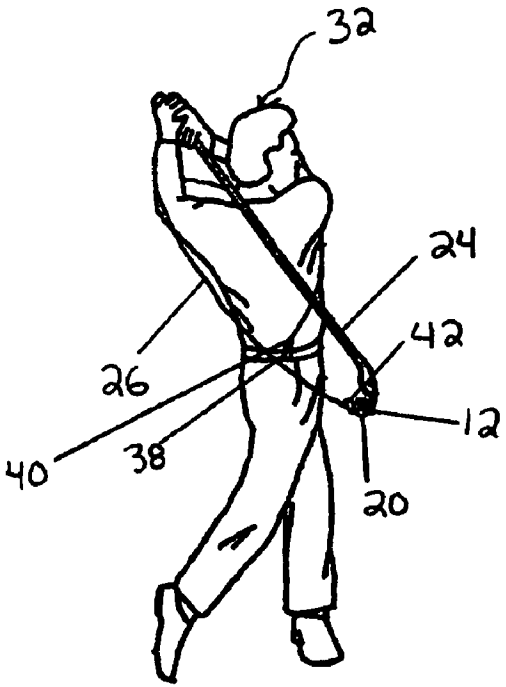
FIGS. 4A-4C illustrate a method by which a trainee such as that shown in FIG. 3 uses the training device shown in FIGS. 1-3.
Figure 4B:
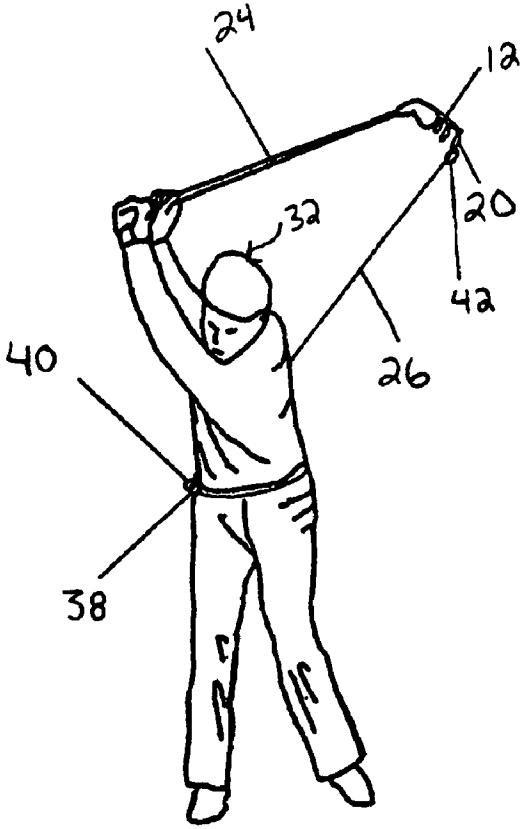
Figure 4A:
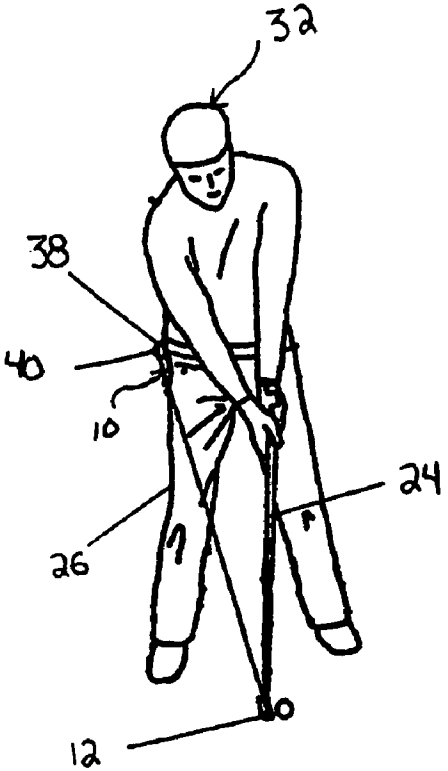

FIGS. 4A-4C depict a method of training the muscles used during a golf swing using the training device of FIGS. 1-3. Although the swinging motion shown in FIGS. 4A-4C is a right-handed golf swing, the training device and methods of using the training device can be used for a left-handed trainee by attaching the tether distal end 30 to the opposite side of the trainee. As shown in FIG. 4A, the trainee 32 is wearing the training device 10, holding a golf club 24, and preparing to initiate the backswing. The trainee 32 is in an initial neutral stance. In this neutral position, the tether 26 extending between the connector 38 and the member 12 is under relatively low tension. As the trainee 32 moves from the neutral position to the backswing position (shown in FIG. 4B), the tether 26 provides resistance to the muscles used during this motion.

FIG. 4B is a front view of the trainee 32 after the completion of the backswing and prior to initiating the down swing. Resistance is provided to the muscles through the tether 26. As the trainee 32, initiates the down swing and moves toward completion of the swing (shown in FIG. 4C), the tether 26 provides resistance to the muscles used to complete the swing in the sequence they are used.

FIG. 4C is a front view of the trainee 32 at the completion of the swing. As shown, the trainee 32 has completed the rotation of his hips and completed the swinging motion. By using the present invention in this manner, the resistance applied to the body throughout the swing strengthens and trains the associated muscles in the order they are used during the golf swing motion.

Figure 5C:
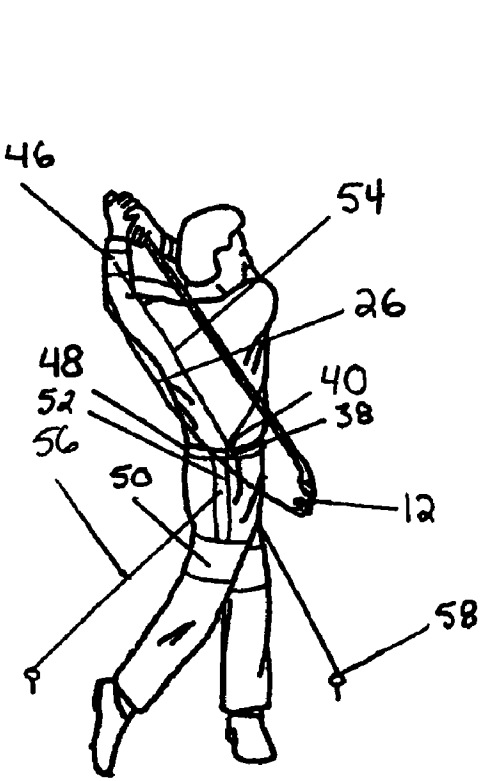
FIGS. 5A-5C illustrate a method of using one embodiment of the training device of the present invention in conjunction with a hitting harness device.
Figure 5B:
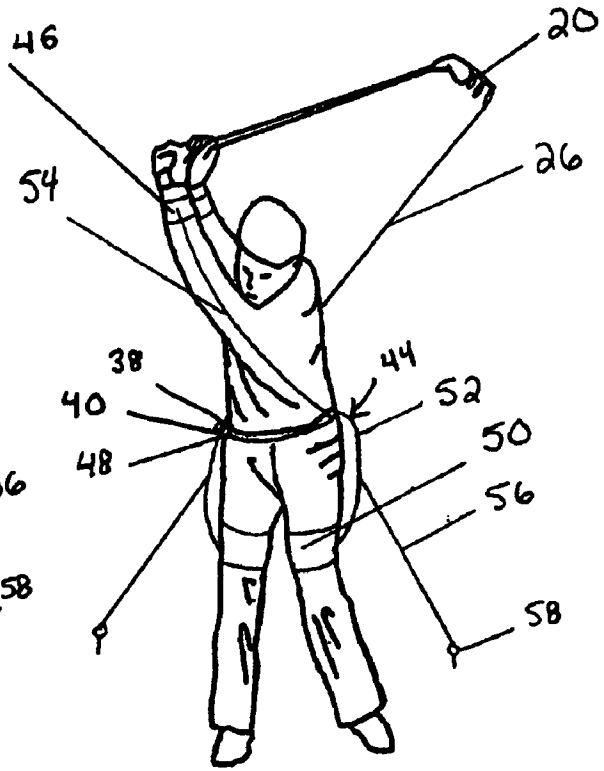
Figure 5A:
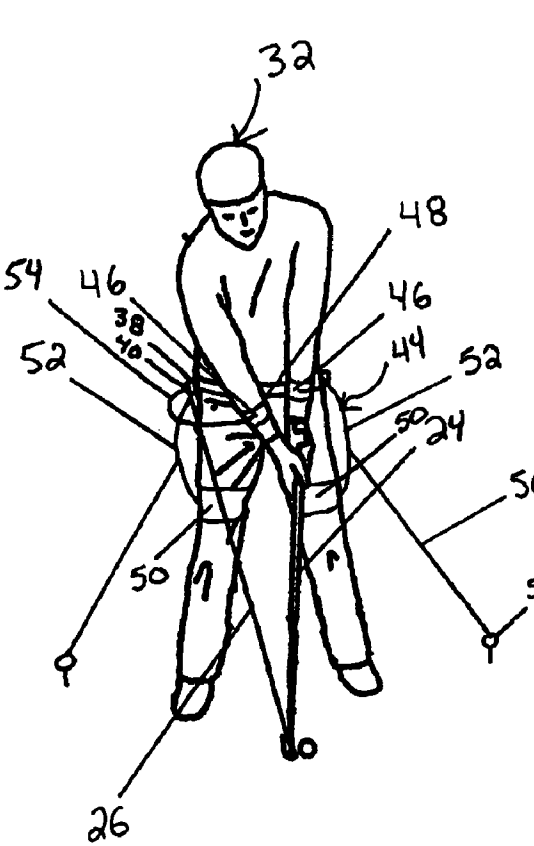

FIGS. 5A-5C depict a trainee 32 using the golf training device 10 in conjunction with a hitting harness 44 for training the muscles used during hitting and swinging movements. One such hitting harness 44 is disclosed in U.S. patent application Ser. No. 11/101,310, filed Apr. 7, 2005 and entitled "TRAINING HARNESS FOR ATHLETIC HITTING AND SWINGING SKILLS" to Frappier, herein incorporated by reference in its entirety. The hitting harness 44 includes lower arm bands 46, waistband 48, and thigh bands 50. Connecting webs 52 connect the thigh bands 50 to the waistband 48. Resilient and extensible arm tethers 54 extend from the lower arm bands 46 to the waistband 48. Resilient and extensible leg tethers 56 extend from the connecting webs 52 to restraints 58. The hitting harness 44 provides resistance to the arm and leg muscles in the sequence they are used to perform the hitting or swinging motion.

As shown in FIG. 5A, the trainee 32 is using the golf training device 10 and is wearing the hitting harness 44. The trainee 32 is preparing to initiate the backswing. The trainee 32 is in an initial neutral stance. In this neutral position, the leg tethers 56 are under relatively lower tension. The arm tethers 54 extend from the lower arm bands 46 to the waistband 48. The connector 38 of the golf training device 10 is located on the right side of the waistband 48. In this neutral position, the arm tethers 54 are under relatively lower tension. As the trainee 32 moves from the neutral position to the backswing position (shown in FIG. 4B), the tension on the tether 26, the left arm tether 54, and the left leg tether 56 is increased.

FIG. 5B is a front view of the trainee 32 after the completion of the backswing and prior to initiating the down swing. Resistance is provided to the arms through the arm tethers 54 and to the hips and legs through the leg tethers 56. More resistance is provided to the left side of the trainee than the right side. Resistance is also provided to the muscles in the sequence they are used to complete the golf swing through the tether 26. As the trainee 32 initiates the down swing and moves toward completion of the swing (shown in FIG. 5C), the tension on the left side decreases and the tension on the right side increases.

FIG. 5C is a front view of the trainee 32 at the completion of the swing. As shown, the trainee 32 has completed the rotation of his hips and his swinging movement. By using the present invention in this manner, the resistance applied to the arms, the hips, and the legs through the tether 26, the arm tethers 54, and the leg tethers 56 throughout the swing strengthens and trains the associated muscles in the order they are used during the golf swing motion.

Figure 6A:
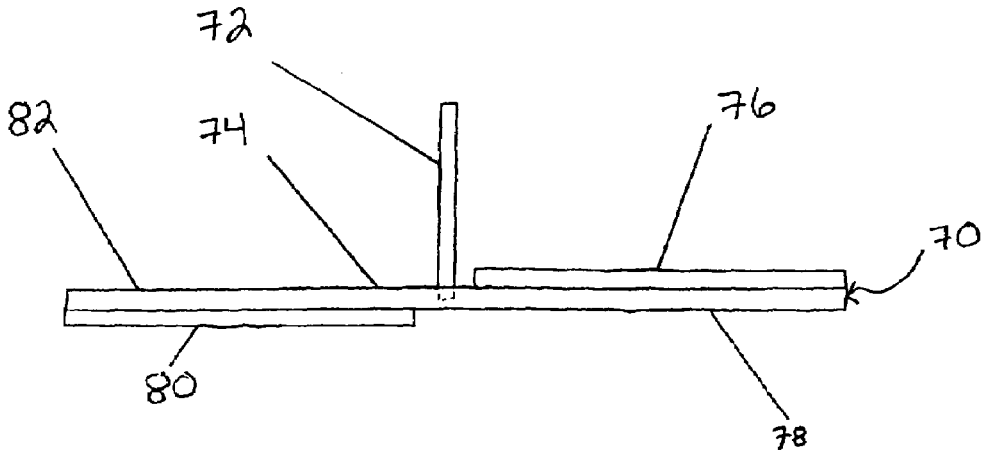
FIGS. 6A-6B illustrate an embodiment of an attachment structure for attaching the training device to a trainee.
Figure 6B:
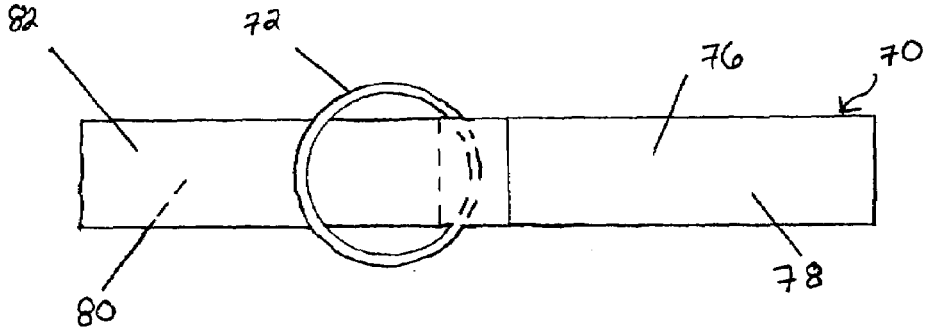

FIGS. 6A-6B depict an alternative body attachment structure 70 for attaching the tether 26 to the trainee 32. The attachment structure 70 includes an connector 72 and an attachment web 74. The connector 74 is inserted through the attachment web 74. Loop material 76 is coupled to a loop end 78 of the attachment web 74, and hook material 80 is coupled to a hook end 82.

Figure 7:
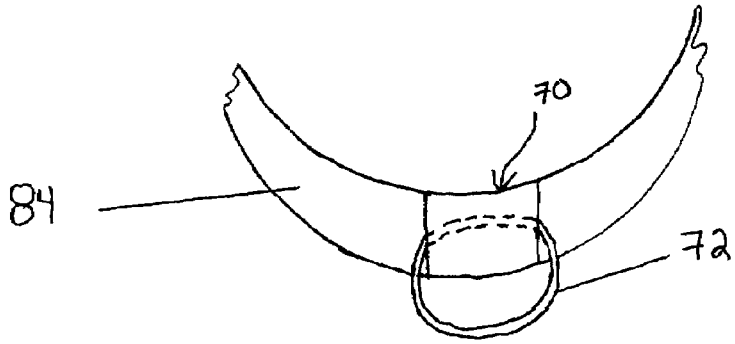
FIG. 7 is a perspective view of the attachment structure of FIGS. 6A-6B in position on a trainee's belt.

FIG. 7 shows the attachment structure 70 in position on a trainee's belt 84. The attachment structure 70 is wrapped around the belt 84 and secured by fastening the hook and loop material 76, 80. The tether 26 can then be connected to the connector 72.

Various modifications and additions can be made to the exemplary embodiments discussed without departing from the scope of the present invention. Accordingly, the scope of the present invention is intended to embrace all such alternatives, modifications, and variations as fall within the scope of the claims, together with all equivalents thereof.

We claim:

1. A device for training the muscles used during a golf club swinging motion, the device comprising:

a golf club or golf club simulation device having a head attached to a shaft;

a mounting member on the golf club head at a location spaced from the shaft;

a first connector structure coupled to the mounting member; and a resilient and extensible tether having a proximal end for connection to the connector structure and a distal end for connection to the right side of a right-handed trainee's body and to the left side of a left-handed trainee's body.

2. The device of claim 1 wherein the connector structure is releasably coupled to the golf club head.

3. The device of claim 1 wherein the device further comprises one or more additional connector structures coupled to the mounting member at spaced-apart locations from the shaft and the first connector structure.

4. The device of claim 3 wherein the mounting member extends from the golf club head in a plane that is generally coplanar with the head.

5. The device of claim 3 wherein the mounting member is permanently coupled to the golf club head.

6. The device of claim 3 wherein the mounting member is releasably coupled to the golf club head.

7. The device of claim 1 wherein the device further includes a structure for engaging a trainee's body and the distal end of the tether is coupled to the structure.

8. The device of claim 7 wherein the structure for engaging a trainee's body comprises a waistband.

9. The device of claim 8 wherein the structure for engaging a trainee's body comprises a band of fastening material adapted for engaging a trainee's belt.

10. A method of training the muscles used during a golf swing of a golf club or golf club simulation device having a head attached to a shaft, the method comprising:

securing a resilient and extensible tether between the right side of a right-handed trainee's body or the left side of a left-handed trainee's body and a location on the golf club head spaced from the shaft, including securing the tether to a connector coupled to a member coupled to the golf club head; and causing the trainee to engage in a golf swing motion so that the tether provides resistance to the trainee's muscles in the sequence used to perform the desired motion.

11. The method of claim 10 wherein the method includes releasably coupling a connector to the golf club head and securing the tether to the connector.

12. The method of claim 10 wherein securing the tether includes securing the tether to one of a plurality of spaced-apart connectors coupled to the member coupled to the golf club head.

13. The method of claim 10 wherein the member extends beyond the head in a plane generally coplanar with a face of the head.

14. The method of claim 10 wherein the method includes releasably mounting the mounting member having the connector to the golf club head and securing the tether to the connector.

15. The method of claim 10 wherein the method includes releasably mounting a mounting member having a plurality of spaced-apart connectors to a golf club head and securing the tether to a connector.

16. The method of claim 10 wherein the method includes securing a structure to the trainee's body and securing the tether to the structure.

* * * * *